United States Patent [19]

Piriz

[11] 4,367,008

[45] Jan. 4, 1983

[54] UNIVERSAL BATTERY POST CONNECTOR

[75] Inventor: Jose M. Piriz, Hillside, N.J.

[73] Assignee: Thomas & Betts Corporation, Raritan, N.J.

[21] Appl. No.: 221,394

[22] Filed: Dec. 30, 1980

[51] Int. Cl.[3] ..... H01R 11/26

[52] U.S. Cl. ..... 339/230 R

[58] Field of Search ..... 339/224–240

[56] References Cited

U.S. PATENT DOCUMENTS

| | | | |
|---|---|---|---|
| 1,564,802 | 12/1925 | Walker | 339/230 R |
| 1,841,371 | 1/1932 | Hughes . | |
| 1,977,179 | 10/1934 | Fisch | 339/229 |
| 2,159,512 | 5/1939 | Rich | 173/259 |
| 2,215,416 | 9/1940 | Wolcott | 173/259 |
| 2,769,964 | 11/1956 | Lartz | 339/226 |
| 2,940,060 | 6/1960 | Haegert | 339/100 |
| 3,116,100 | 12/1963 | Hunter | 339/228 |

*Primary Examiner*—Joseph H. McGlynn

*Attorney, Agent, or Firm*—Robert M. Rodrick; Salvatore J. Abbruzzese; Jesse Woldman

[57] ABSTRACT

A universal battery post connector for use with both positive and negative terminals on a storage battery comprises an apertured, split body and a pair of spaced opposed arms extending in parallel therefrom. The body is contractable about the battery post upon movement of the arms closer together such as by means of a conventional bolt and nut. An abutment is provided at the distal end of each arm, each abutment extending toward each other and aligned to engage when the arms are drawn closer together. The abutments have inclined opposing inner surfaces that converge toward each other and that lie obliquely relative to the axis along which the body aperture extends. Upon tightening of the nut on the bolt the inclined opposed abutment surfaces are brought into contact in a common plane, such movement providing an additional measure of contraction of the body about the battery post.

16 Claims, 6 Drawing Figures

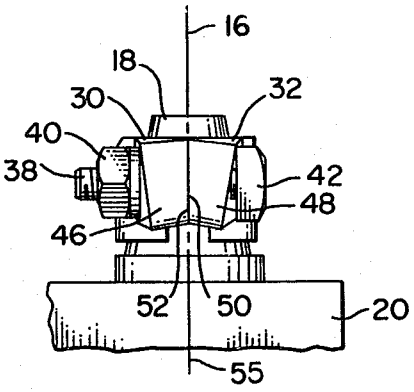
FIG. 5
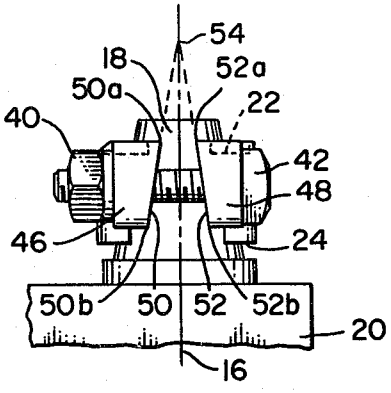
FIG. 4
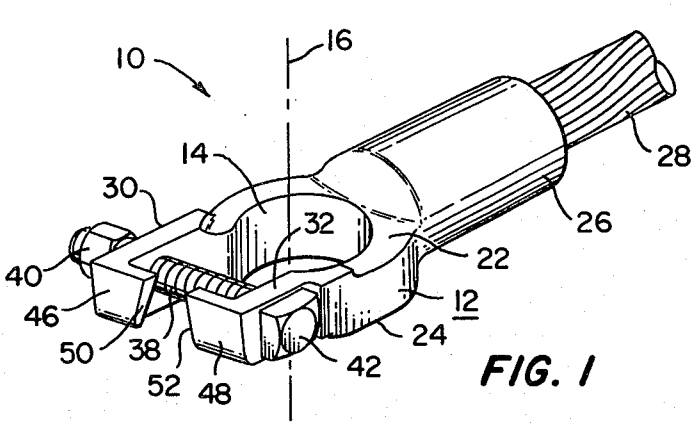
FIG. 1
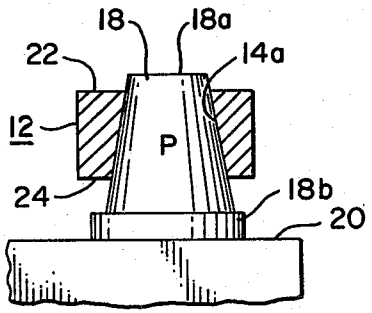
FIG. 6
FIG. 3
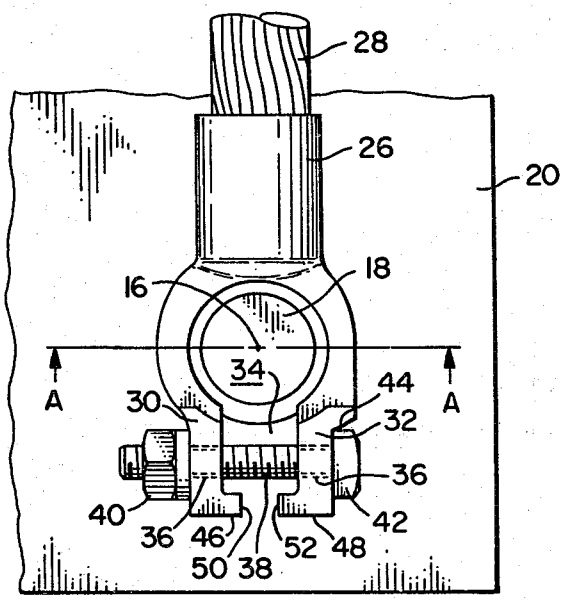
FIG. 2

UNIVERSAL BATTERY POST CONNECTOR

FIELD OF THE INVENTION

This invention relates to a post clamping apparatus and, more particularly, to a battery post connector constructed for use in making connections to battery posts of varying sizes.

BACKGROUND OF THE INVENTION

A number of battery post clamping devices have been developed in the prior art with configuration adapted to receive both the positive and negative terminal posts in a storage battery, such as an automobile battery. These are the so-called "universal" battery post connectors. They are intended to accept both positive and negative terminal posts, the positive terminal generally being somewhat larger in size than the negative terminal for polarity identification purposes. Such posts are often tapered to facilitate tightening of the connector therearound.

The typical battery post connector commercially available comprises an apertured, split deformable body adapted to be clamped about the battery terminal. Such a connector generally includes a pair of spaced parallel lugs that are drawn together to clamp the battery post by a bolt and nut. These connectors are typically designed to fit properly on the smaller, negative terminal post. As such, insertion onto the larger, positive post initially provides only a partial fit as the connector aperture is too small to fully accommodate the larger diameter of the positive terminal post. To provide a proper fit on the positive post, the connector aperture is often opened by mechanical means, such as a screwdriver. In addition to being time consuming, such manipulation has a tendency to distort the connector aperture which may cause voids in the connection interface with a consequent reduction in electrical conductivity and potentially accelerated corrosion.

With the known battery post connector configurations, a mere change in design to initially properly fit the larger, positive terminal post is undesirable as the additional clearance about the smaller, negative terminal results in reduced compression about the post or requires excessive torque to provide a suitable connection.

SUMMARY OF THE INVENTION

It is an object of the present invention to provide an improved post clamping apparatus.

It is another object of the present invention to provide a battery post connector capable in one configuration of suitably clamping to battery terminal posts of varying sizes.

In accordance with the invention, a post clamping apparatus comprises a deformable body having an aperture extending therethrough along an axis for receiving a post. A pair of arms extend outwardly from the body in spaced relation relative to each other and define therebetween an opening in communication with the aperture. The body is contractable about the post upon movement of the arms toward each other. A projection is provided on at least one of the arms, such projection being spaced outwardly from the aperture and extending toward an inner surface of the other arm for engagement therewith when the arms are moved toward each other. The projection has an inner surface facing the inner surface of the opposing arm. One of the inner surfaces is inclined obliquely relative to the axis and converges toward the other inner surface. Included is means operative for moving the arms toward each other and the projection into engagement with the opposing arm. The means are further operative to move the arm inner surface and the projection inner surface into contact in a common plane.

In a preferred embodiment of the invention, the post clamping apparatus is useful as a battery post connector. In such preferred form, a projection defining an abutment is provided at the distal end of each arm, such abutments being positioned to be in abutting relation when the arms are moved closer together. The abutments have thereon opposed inner surfaces that lie in respective planes that are inclined obliquely relative to the aperture axis to intersect each other. In a particular form, the connector body may have a lower surface and a spaced substantially parallel upper surface, the aperture extending transversely through such surfaces. The inner surfaces of the abutments may be inclined obliquely relative to the upper and lower body surfaces and converge toward each other.

BRIEF DESCRIPTION OF THE DRAWING

FIG. 1 is a perspective view of a battery post connector in accordance with the invention.

FIG. 2 is a fragmentary plan view of the connector of FIG. 1 on a positive post terminal of a storage battery in an unclamped condition.

FIG. 3 is a partially sectioned view of FIG. 2 as seen along viewing lines A—A.

FIG. 4 is a front elevational view of the connector on the battery post as shown in FIG. 2.

FIG. 5 is a view of FIG. 4 illustrating the connector in a clamped condition.

FIG. 6 is a sectional view similar to FIG. 3 showing the connector on a negative post terminal in an unclamped condition.

DETAILED DESCRIPTION OF THE PREFERRED EMBODIMENTS

Referring to the drawing, there is shown in FIG. 1 a battery post connector 10 comprising a main portion or body 12 having a circular aperture 14 extending therethrough along a vertical axis 16. The connector 10 as shown in FIG. 2 is adapted to surround and be clamped upon a conventional upstanding terminal post 18 on a storage battery 20 such as for use in an automobile. As will be detailed, the connector 10 is adapted to readily and fully accommodate the positive, larger terminal post without prying and to be clamped onto the negative, smaller terminal with sufficient compressive force to provide a suitable connection.

The body 12 comprises a deformable material and, in the preferred form, is in the shape of a truncated cylinder having an upper planar surface 22 and a spaced, substantially parallel lower planar surface 24. The aperture 14 extends transversely through the upper surface 22 and the lower surface 24, the aperture axis 16 being substantially orthogonal thereto. Preferably the aperture 14 has a tapered surface **14*a* as shown in FIG. 3 defining a frustro-conical shape to mate with the tapered post 18, the larger opening of such shape opening at the lower body surface 24. Adjoining one end of the body 12 is a cable socket 26 in the form of a hollow barrel adapted to receive therein a flexible conductive cable 28. The conductive cable 28 is securely mechanically and electrically clamped within the socket 26** by crimping devices or other fastening means well known in the art.

Extending outwardly from the body 12 opposite the socket 26 are a pair of spaced, opposing arms 30 and 32, preferably extending parallel to each other and substantially orthogonal to the aperture axis 16, the arms 30 and 32 defining an opening 34 therebetween in communication with the aperture 14. The arms 30 and 32 each have a bolt receiving aperture 36 extending transversely therethrough for reception of a bolt 38 on which a nut 40 is threadably affixed in a customary manner. The head 42 of the bolt 38 engages a shoulder 44 on the arm 32 so that upon tightening of the nut 40 on the bolt 38, the arms 30 and 32 are moved toward and away from one another whereby the body 12 and the aperture 14 are contracted and expanded about the post 18 as the case may be. A similar shoulder may be provided on the arm 30 such that the bolt 38 may be inserted through the arm apertures 36 from either direction.

To prevent distortion of the arms 30 and 32 upon such tightening of the nut 40, abutments 46 and 48 in the form of projections are provided on the arms 30 and 32, respectively. The abutments 46 and 48 are arranged to be in alignment and to extend toward each other, preferably at the distal ends of the arms 30 and 32. Where the arms 30 and 32 extend in parallel to each other, it is preferred that the abutments extend normally from the inner surfaces of the opposing arms 30 and 32. As the nut 40 is tightened and the arms 30 and 32 are moved closer together, the abutments 46 and 48 are adapted to engage each other, while the inner ends of the arms 30 and 32 that merge with the body 12 are free to move toward one another to contract the body 12 about the post 18 for clamping thereto.

In accordance with the invention as shown more clearly in FIG. 4, the abutments 46 and 48 have spaced opposing inner surfaces 50 and 52, respectively, that converge toward each other and that lie in respective planes inclined obliquely with respect to the aperture axis 16 to intersect, such as at point 54. In the preferred form where the body 12 has upper and lower substantially parallel surfaces 22 and 24, the facing inner surfaces 50 and 52 are inclined at an oblique angle with respect to such body surfaces 22 and 24. The inner surfaces 50 and 52 terminate at upper edges **50*a* and 52*a*, respectively, lying adjacent the upper body surface 22. Lower edges 50*b* and 52*b* respectively terminate the inner surfaces 50 and 52 adjacent the lower surface 24. The transverse spacing between the lower edges 50*b* and 52*b* in the preferred arrangement is greater than the transverse spacing between the upper edges 50*a* and 52*a***.

As illustrated in FIGS. 2, 3 and 4, the connector 10 as described herein is resting on a battery terminal post 18 in an unclamped condition. It is preferred that the aperture 14 be formed such that a larger, positive terminal be accommodated therein, whereby the upper surface 22 is below the upper post portion **18*a* of the post 18, the lower surface 24 is above the post base 18*b* and the tapered aperture surface 14*a* is loosely mated with the tapered post 18. Upon tightening of the nut 40 on the bolt 38, the abutments 46 and 48 are brought closer together until the upper edges 50*a* and 52*a* come into engagement. Continued tightening of the nut 40 will not only contract the body 12 about the post 18 but will cause the lower edges 50*b* and 52*b* to be drawn toward each other, as shown in FIG. 5, until the opposing inner surfaces 50 and 52 contact each other along a common plane 55, such plane 55 lying preferably parallel the aperture axis 16 and substantially orthogonal to the body surfaces 22 and 24. This driving together of the lower edges 50*b* and 52*b* produces a twisting action of the arms 30 and 32 about a point defined by the engaged edges 50*a* and 52*a* and causes the body 12 to further contract an additional measure on the post 18 with the greatest additional contraction being at the lower body surface 24 by virtue of the additional movement of lower edges 50*b* and 52*b*** adjacent thereto.

Such a connector construction provides advantage in overcoming tolerance variations between the tapered post 18 and the body aperture 14 as well as accommodating a greater degree of distorted and uneven post surfaces. More significantly, the additional measure of contraction provided by the engagement of the inclined opposing surfaces 50 and 52 allows the connector 10 to be used with posts of varying sizes. For example, as shown in FIG. 6, a negative post 56 on the battery 20 is smaller than the positive post 18. A connector 10, designed to readily receive the positive post 18, will freely fit over the negative post 56 with a clearance 58 between the inner tapered aperture surface **14*a* and the outer surface of the post 56 due to the smaller size of the post 56. The transverse spacing between the lower inclined surface edges 50*b* and 52*b* is formed such that the additional measure of contraction of the body 12 is sufficient to overcome the clearance 58 and clamp onto the post 56 in a substantially voidless interface. Thus, the connector 10** may be readily used as a universal connector in making connection with a single configuration to both positive and negative battery posts.

While the connector body 12 has been described herein as comprising deformable material, it is preferred that the connector 10, embodying the body 12, the barrel socket 26, the arms 30 and 32 and the abutments 46 and 48 thereon be formed integrally of such deformable material. It is preferred that such a connector 10 be formed of copper in a casting process although other suitable materials and fabrication processes may be used.

Although the preferred embodiments of the connector 10 have been described herein, it should be appreciated that over variations may be made within the scope of the invention. For example, an abutment may be provided on only one of the arms 30 or 32 adapted to engage an inner surface of the opposing arm. The inner surface of such abutment may be inclined as described hereinabove with reference to FIG. 4 to lie obliquely relative to the aperture axis 16 and to converge toward the inner surface of the opposing arm. Alternatively, the inner surface of the opposing arm may be so inclined, or both may be so inclined.

Various other changes to the foregoing, specifically disclosed embodiments and practices will be evident to those skilled in the art. Accordingly, the foregoing preferred embodiments are intended in an illustrative and not in a limiting sense. The true spirit and scope of the invention are set forth in the following claims.

What is claimed is:

1. A post clamping apparatus, comprising:

a deformable body having an aperture extending therethrough along an axis for receiving a post;

a pair of arms extending outwardly from said body in spaced relation relative to each other and defining therebetween an opening in communication with said aperture, said body being contractable about said post upon movement of said arms toward each other;

a projection on at least one of said arms spaced outwardly from said aperture and extending toward an inner surface of said other arm for engagement therewith when said arms are moved toward each other, said projection having an inner surface facing the inner surface of said opposing arm, one of said inner surfaces being inclined obliquely relative to said axis and converging toward said other inner surface;

means operative for moving said arms toward each other and said projection into engagement with said opposing arm, said means being further operative to move said arm inner surface and said projection inner surface into contact in a common plane.

2. An apparatus according to claim 1, wherein said post receiving aperture has a substantially circular cross-section.

3. An apparatus according to claim 1, wherein said post receiving aperture has a tapered surface defining a frusto-conical shape.

4. An apparatus according to claim 1, wherein said moving means comprises a bolt receiving opening through each of said arms, a bolt extending through said bolt openings and a nut associated with said bolt to effect upon tightening on said bolt movement of said arms toward each other.

5. An apparatus according to claim 1, wherein a projection is included on each of said arms at a position to engage each other when said arms are moved toward each other.

6. An apparatus according to claim 5, wherein the inner surfaces of both projections are obliquely inclined relative to said axis.

7. An apparatus according to claim 6, wherein said arms extend substantially parallel to each other.

8. An apparatus according to claim 7, wherein said projections extend substantially normally from the respective arms.

9. A battery post connector comprising:

a deformable body having an aperture extending therethrough along an axis for receiving an upstanding battery post;

a pair of arms extending outwardly from said body in spaced relation relative to each other and defining an opening therebetween in communication with said aperture, said body being contractable about said battery post upon movement of said arms toward each other;

an abutment on each arm extending toward each other and positioned thereon to abut when said arms are moved closer together, said abutments having thereon opposed inner surfaces that lie in respective planes inclined obliquely relative to said axis to intersect each other;

means operative for moving said arms closer together, said abutments into abutting relation and said opposed inner surfaces into contact in a common plane, the movement of said opposed inner surfaces into contact providing an additional measure of contraction of said body about said post.

10. A battery post connector, comprising:

a deformable body having a lower surface and a spaced substantially parallel upper surface, an aperture extending transversely through said lower and upper surfaces for receiving an upstanding battery post;

a pair of opposed arms extending outwardly from said body in spaced relation relative to each other and defining an opening therebetween in communication with said aperture, said body being contractable about said battery post upon movement of said arms toward each other;

an abutment on each arm extending toward each other and positioned to abut when said arms are moved closer together, said abutments having thereon opposed inner surfaces that lie in respective planes inclined obliquely relative to the upper and lower surfaces of said body and converging toward each other;

means operative between said arms for moving said arms closer to each other, said abutments into abutting relation and said opposed inner surfaces into contact along a plane substantially orthogonal to said upper and lower surfaces.

11. A battery post according to claim 10, wherein said abutments extend at the distal ends of each arm.

12. A battery post connector according to claim 10, wherein said battery post receiving aperture has a substantially circular cross-section.

13. A battery post connector according to claim 10, wherein said abutments are formed integrally with said arms.

14. A battery post connector according to claim 10, wherein said moving means comprises a bolt receiving opening through each of said arms, a bolt extending through each of said bolt openings and a nut associated with said bolt to effect upon tightening on said bolt movement of said arms toward each other.

15. A battery post connector according to claim 10, wherein said battery post receiving aperture has a tapered surface defining a frustro-conical shape, the larger opening of which opens at said lower body surface.

16. A battery post connector according to claim 15 wherein said inner surfaces of said abutments each have lower and upper terminations lying adjacent to the lower and upper body surfaces, respectively, the transverse spacing between the inner surfaces at the lower terminations being greater than at the upper terminations.

* * * * *